United States Patent [19]

Mummert

[11] 4,408,599

[45] Oct. 11, 1983

[54] APPARATUS FOR PNEUMATICALLY CONTROLLING A DYNAMIC PRESSURE WAVE DEVICE

[75] Inventor: Thomas A. Mummert, Toledo, Ohio

[73] Assignee: Jobst Institute, Inc., Toledo, Ohio

[21] Appl. No.: 289,489

[22] Filed: Aug. 3, 1981

[51] Int. Cl.[3] ..... A61H 1/00

[52] U.S. Cl. ..... 128/24 R

[58] Field of Search ..... 128/1 R, 24 R, 60, 40, 128/34, 297–299, 30, 204.21, 38, DIG. 20, 205.12

[56] References Cited

U.S. PATENT DOCUMENTS

| | | | |
|---|---|---|---|
| 2,719,986 | 10/1955 | Rand | 128/24 R |
| 2,781,041 | 2/1957 | Weinberg | 128/24 R X |
| 2,896,612 | 7/1959 | Bates et al. | 297/DIG. 3 X |
| 3,880,149 | 4/1975 | Kawaguchi | 128/24 R |
| 3,923,053 | 12/1975 | Jansson | 128/205.12 |
| 4,066,084 | 1/1978 | Tillander | 128/24 R X |
| 4,338,923 | 7/1982 | Gelfer et al. | 128/24 R |

*Primary Examiner*—Kyle L. Howell

*Assistant Examiner*—Christine A. Fukushima

*Attorney, Agent, or Firm*—Wilson, Fraser, Barker & Clemens

[57] ABSTRACT

A source of pressurized gas is attached to a dynamic pressure wave appliance. The pneumatic control circuit connects the source of pressurized gas to a first chamber of the appliance. When the pressure in the first chamber reaches a first predetermined level, a valve seals the first chamber and connects the source so as to inflate a second chamber about the first. When the pressure in the second chamber reaches a second predetermined level, a valve permits the first chamber to deflate while continuing to connect the second chamber for inflation. A valve for sealing the inflated sleeve discontinues the inflation of the sleeve when the pressure therein reaches a third predetermined level. The sequence of operation of the pneumatic control circuit will cause a suitable dynamic pressure wave appliance to apply a pressure to a human or animal extremity which begins at the most distant end and travels up the extremity in the nature of a pressure wave.

14 Claims, 9 Drawing Figures

FIG. 4A
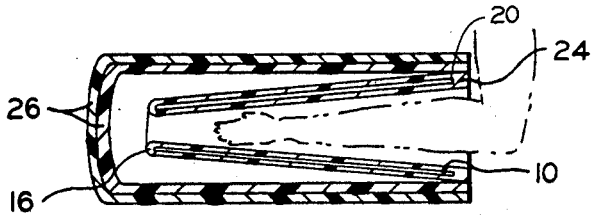
FIG. 4B
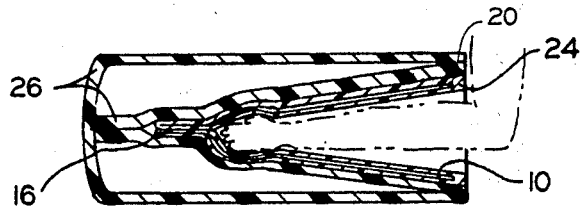
FIG. 4C
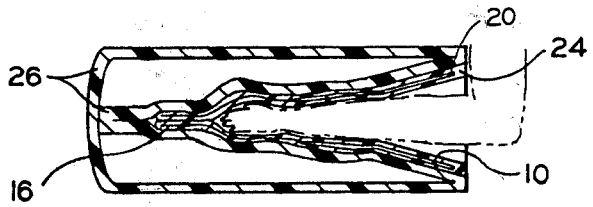
FIG. 4D
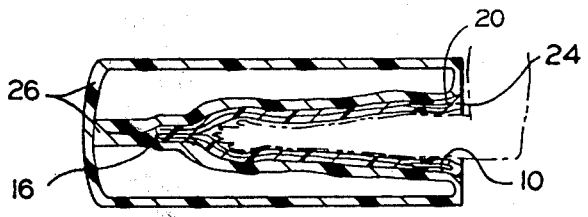
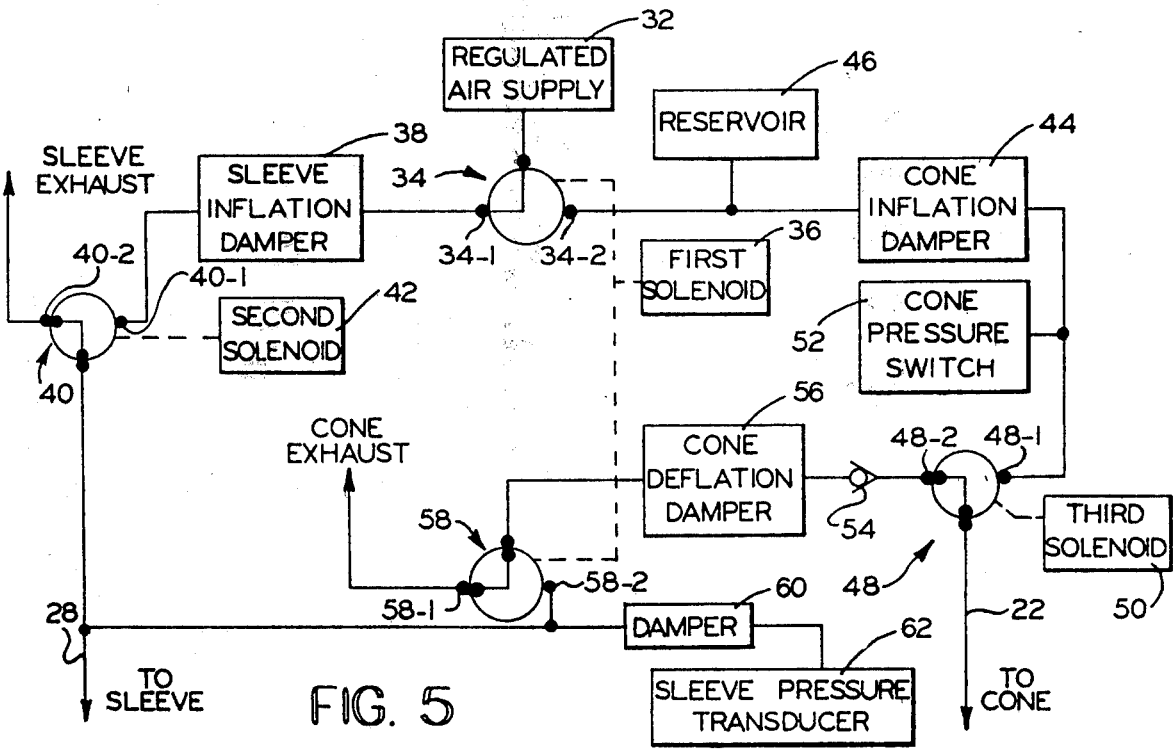
FIG. 5

APPARATUS FOR PNEUMATICALLY CONTROLLING A DYNAMIC PRESSURE WAVE DEVICE

CROSS-REFERENCES TO RELATED APPLICATIONS

This application is related in subject matter to co-pending application Ser. No. 289,380, filed Aug. 3, 1981, entitled "APPARATUS AND METHOD FOR APPLYING A DYNAMIC PRESSURE WAVE TO AN EXTREMITY" and co-pending application Ser. No. 289,267, filed Aug. 3, 1981, entitled "ELECTRONIC CIRCUIT FOR A DYNAMIC PRESSURE WAVE PNEUMATIC CONTROL SYSTEM", with each being assigned to the same assignee as this application.

BACKGROUND OF THE INVENTION

1. Field of the Invention

The present invention relates in general to pneumatic therapeutic devices, and in particular to a pneumatic control system for a dynamic pressure wave device.

2. Description of the Prior Art

In the field of medical treatment, it is known that the application of pressure is helpful in the treatment of edema of the extremities as well as in the therapeutic prophylaxis for the prevention of deep vein thrombosis. There are two general types of pneumatic appliance systems known in the prior art for such treatment. One system utilizes a single chamber appliance to provide uniform compression of the extremity. The second system, often referred to as a sequential compression system, utilizes an appliance made up of a series of chambers or segments. In use, a sequential device inflates these appliance chambers one at a time, starting from the end of the appliance surrounding the most distal portion of the extremity until all of the chambers are inflated. Some inflation devices inflate all of the chambers to a uniform pressure while other devices inflate the most distal chamber to the highest pressure and subsequent chambers to a progressively lower pressure, thereby causing a pressure gradient. In all of the above-described devices, a pneumatic control system is electrically or mechanically operated to provide the desired results.

U.S. Pat. No. 2,781,041 discloses an appliance which includes a plurality of cuffs which are inflated in sequence. The inflation and deflation is controlled by a rotary distributor valve which connects each cuff in sequence to a source of compressed air and vents all the cuffs at the same time.

U.S. Pat. No. 3,811,431 discloses an apparatus for providing circulatory assistance to a bed patient to preclude the pooling or clotting of venous blood in the legs or other extremities. A plurality of pairs of pressure cuffs are disposed along the leg of the patient needing circulatory assistance. The cuffs are sequentially inflated through a programming means which can be rotary valve driven by a clock spring motor or fluidic flip flops. A pressure gauge is utilized to control a regulator valve for the compressed air source.

U.S. Pat. No. 3,892,229 discloses an apparatus for alternately applying intermittent compression to the legs of a patient. The control circuit includes a pressure regulating valve for reducing the available inlet supply pressure and an adjustable metering valve for variably controlling the volumetric flow rate of gas to each legging to thereby control the time rate of pressure build-up of each pulse. Respective adjustable pressure relief valves are also provided for variably controlling the maximum pressure permitted in each legging and for relieving the pressure at the end of each pulse. The control circuit includes a timing system for causing the pulses to be delivered at alternate regular intervals to the respective leggings, such timing system comprising a two-diaphragm cycling valve for automatically regulating the alternate charge and discharge of a pair of accumulator tanks, each tank controlling by means of a predetermined rate of pressure increase the timing of the pulses to the respective leggings.

U.S. Pat. No. 4,013,069 discloses a device for applying compressive pressures against a patient's limb from a source of pressurized fluid. The appliance is a sleeve having a plurality of separate fluid pressure chambers progressively arranged longitudinally along the sleeve from the lower portion of the limb to an upper portion of the limb proximal the patient's heart relative to the lower portion. Pneumatic timers are utilized to control the inflation and deflation of the various cuffs.

SUMMARY OF THE INVENTION

The present invention relates to a control system for a pneumatic compression appliance wherein the flow rates in and out of the appliance chambers, as well as the pressures developed within the chambers, require specific control. Electrically-operated solenoid valves are connected to provide a predetermined sequence of operations. Initially, all of the chambers are vented to the atmosphere and the pneumatic input of the appliance is regulated or otherwise limited to a preset maximum value. Upon activation, pneumatic flow is conducted to an inner cone chamber at a rate controlled by a cone inflation rate restrictor. Such flow is allowed to continue until the cone pressure reaches a predetermined value. At that point, the solenoid controls are energized so as to discontinue the pneumatic flow to the cone and conduct the pneumatic flow to a sleeve which surrounds the cone. The rate of inflation of the sleeve is controlled by a sleeve inflation rate restrictor. Pneumatic flow conducted to the sleeve is allowed to continue until an initial wave pressure value is reached in the sleeve, as sensed by a pressure transducer bridge element.

Upon reaching the wave pressure value, the solenoids are actuated so as to permit deflation of the inner cone chamber while the sleeve chamber continues to be inflated. The maintenance or build-up of pressure in the sleeve causes the cone to collapse and apply a dynamic pressure wave against the extremity which travels as a function of sleeve inflation versus cone deflation rates. Pneumatic flow is allowed to continue into the sleeve chamber until the pressure in the sleeve reaches a final pressure value as sensed by the pressure transducer bridge. When the final pressure value is reached, the solenoids are actuated to cut off the pneumatic flow and seal both the sleeve and cone chambers. Thus, the appliance applies a uniform pressure to the extremity contained therein.

It is an object of the present invention to provide a pneumatically-actuated dynamic pressure wave therapeutic device having an enhanced therapeutic effect.

It is a further object of the present invention to provide a pneumatic control system for a dynamic pressure wave device. f It is a further object of the present invention to provide an electronic circuit for regulating a pneumatic control system for a dynamic pressure wave device.

Other objects and advantages of the present invention will become apparent to those skilled in the art from the following detailed description of the preferred embodiment of the present invention, when read in light of the accompanying drawings.

BRIEF DESCRIPTION OF THE DRAWINGS

FIGS. 4A through 4D are schematic sectional views illustrating the operation of the dynamic wave pressure device of FIG. 3;

FIG. 5 is a schematic block diagram of the pneumatic control circuit of the dynamic pressure wave device of FIG. 3.

DETAILED DESCRIPTION OF THE PREFERRED EMBODIMENT

Figure 1:
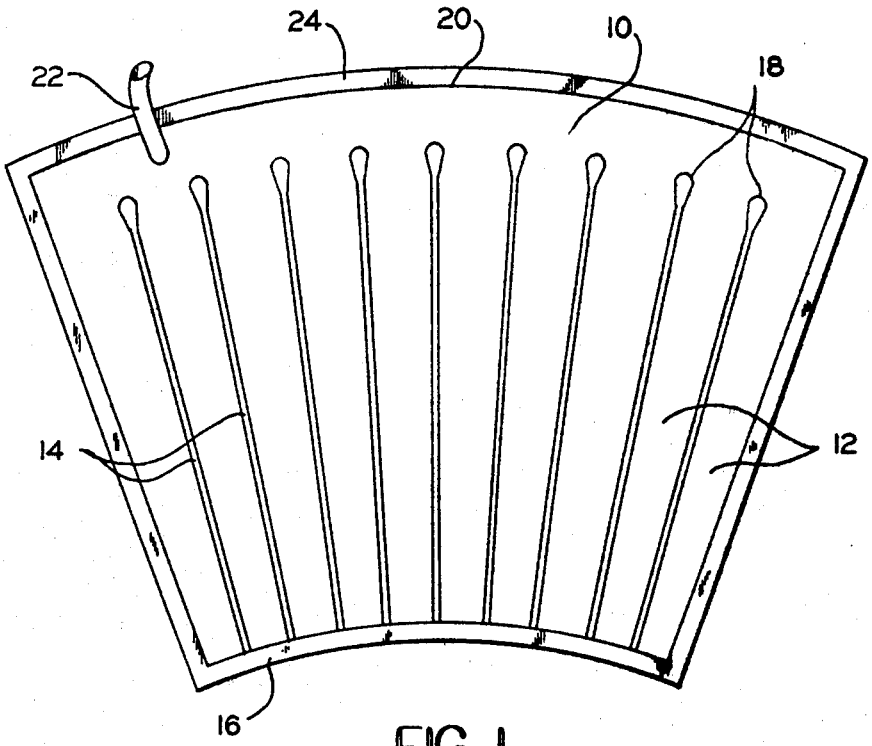
FIG. 1 is an elevational view of the cone chamber of the present invention in an unwrapped position.

Referring now to the drawings, there is illustrated in FIG. 1 an inflatable cone-shaped chamber 10 of a dynamic pressure wave apparatus in accordance with the present invention. The cone 10 includes a plurality of individual tapered tubular chambers 12 which are connected along their longitudinal edges to form a segment of an annulus. The cone 10 is preferably formed of a flexible air-tight material, such as a urethane-coated nylon twill, and is shaped as a generally flat bladder. A plurality of longitudinally extending ribs 14 are formed by heat-sealing the opposing flat sides of the cone 10. The ribs 14 define the adjacent edges of the tubular chambers 12 and prevent the flow of air therebetween. Each rib 14 extends down to an inner end 16 of the cone 10, thus sealing all of the chambers 12 at their inner ends.

The other end of each rib 14 terminates in an enlarged seal portion 18 which is spaced apart from an outer end 20 of the cone 10. The enlarged seal portions 18 prevent the heat-sealed ribs 14 from splitting apart when the cone 10 is inflated. Since the ribs 14 do not extend completely to the outer end 20 of the cone 10, a common bladder area joins the ends of the tubular chambers 12 and air can flow freely therebetween. The common bladder area of the cone 10 is connected to a flexible tube 22 at a conventional port or opening formed in the cone 10. The flexible tube 22 provides a means for connecting the cone 10 to a supply of pressurized air to pump air into the cone 10 and to exhaust air therefrom. The outer end 20 of the cone 10 can be provided with a fastener 24 to secure the cone 10 to the other parts of the dynamic pressure wave apparatus.

Figure 2:
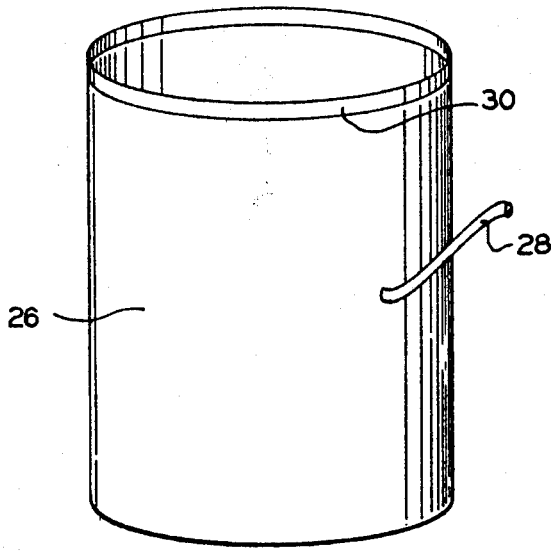
FIG. 2 is a perspective view of the sleeve chamber of the present invention.

FIG. 2 illustrates an inflatable sleeve chamber 26 of a dynamic pressure wave apparatus in accordance with the present invention. The sleeve 26 consists of a flexible air-tight bag-type bladder which is open at the top and closed at the bottom. The sleeve 26 can include an extended foot portion (not shown) to fit comfortably over a leg. The sleeve 26 is connected to a flexible tube 28 at a conventional port or opening formed in the sleeve 26. The flexible tube 28 provides a means for connecting the sleeve 26 to a source of pressurized air to pump air into the sleeve 26 and to exhaust air therefrom. The open end of the sleeve 26 can be provided with a cooperating fastener 30 to releasably secure the open end of the sleeve 26 to the outer end 20 of the cone 10. Any conventional fastening means can be utilized to releasably secure the two fastening strips 24 and 30 together.

Figure 3:
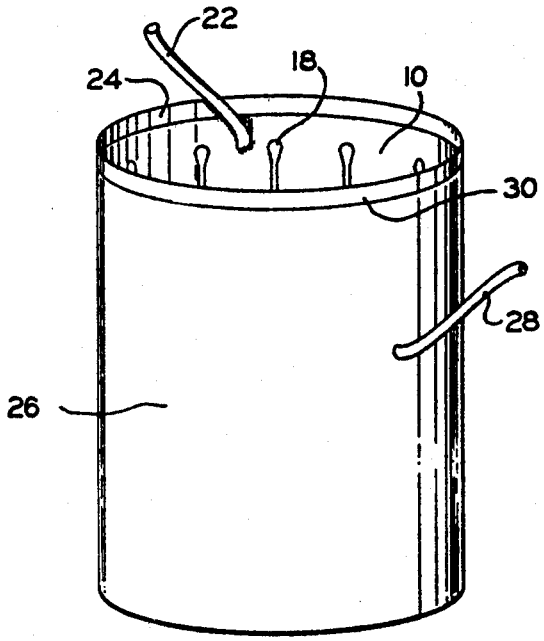
FIG. 3 is a perspective view illustrating the cone chamber of FIG. 1 wrapped and inserted within the sleeve chamber of FIG. 2.

FIG. 3 illustrates the assembled dynamic pressure wave device. The cone 10 is wrapped such that the open longitudinal edges of the cone 10 are adjacent each other, thus forming a cylindrical tapered cone having two open ends. The cone 10 is then inserted within the sleeve 26 and the two chambers are joined along their open top ends by conventional means such as sewing or by the fasteners 24 and 30. It will thus be appreciated that the open end of the sleeve 26 is approximately the same diameter as the diameter of the outer end 20 of the cone 10 when the cone 10 is wrapped. The device also can include an inner liner (not shown) formed of a resilient compressible material secured at the top end with the cone and sleeve and extending through the interior of the cone. The bottom end of the inner liner can be secured to the bottom end of the sleeve when it is closed.

FIGS. 4A through 4D schematically illustrate one cycle of the operation of the dynamic wave pressure apparatus. The pneumatic control system for operating the dynamic wave pressure apparatus and the electric circuit for regulating the pneumatic control system will be described in detail below. An extremity, such as an arm shown in broken line, is inserted into the interior of the apparatus and the cone 10 is inflated to form a semi-rigid structure, as illustrated in FIG. 4A. The cone 10 surrounds the extremity but does not apply any pressure thereto. When the pressure in the cone 10 reaches a predetermined level, the inflation is discontinued and the tube 22 is blocked. While the cone 10 remains fully inflated, air pressure is introduced to the interior of the sleeve 26, causing the sleeve 26 to exert a compressive force on the exterior of the cone 10. This compressive force increases as the air pressure within the sleeve 26 increases. The rigidity of the inflated cone 10, however, retards or limits the compressive force applied to the extremity by the sleeve 26.

When the pressure within the sleeve 26 reaches a first predetermined level, typically lower than the pressure in the cone 10, the tube 22 is unblocked to slowly vent the pressurized air contained in the cone 10 to the atmosphere. As the air pressure within the cone 10 decreases, it loses its rigidity. Simultaneously, the sleeve 26 continues to be inflated and exert increasing compressive force on the exterior of the cone 10 until, as shown in FIG. 4B, the cone 10 begins to collapse inwardly around the extremity. Because of the tapered shape of the cone 10, the region near the inner edge 16 has less surface area exposed to the pressurized gas within the cone 10 and, therefore, is the weakest portion of the cone 10. Thus, the smaller inner edge 16 of the cone 10 will collapse initially due to the force exerted by the sleeve 26.

As the inflation of the sleeve 26 and the deflation of the cone 10 continue, the cone 10 continues to collapse. As a result, a dynamic pressure wave is applied to the extremity. Within the region of partial collapse of the cone 10, a pressure exists on the extremity which varies from the ambient air pressure at the point where the cone has not yet collapsed to the point of contact with the extremity, to the full pressure of the sleeve 26 at the point where the cone 10 is completely collapsed and offers very little or no restraining resistance to the sleeve 26. The inflation of the sleeve 26 and the deflation of the cone 10 are adjusted in such a manner as to cause a smooth collapsing motion from the smaller inner edge 16 of the cone 10 towards the larger outer edge 20, as shown in FIG. 4C. This controlled collapsing motion thus allows the pressure within the sleeve 26 to be exerted circumferentially against the inserted extremity at areas where the cone 10 has collapsed but prevents such circumferential contact at areas where the cone 10 is still semi-rigid and has not collapsed.

The dynamic pressure wave cycle is complete when the sleeve 26 is completely inflated as shown in FIG. 4D. The cone 10 is either completely deflated or has some volume of air remaining at the pressure of the sleeve when the final sleeve pressure is reached. Under these conditions, the cone 10 is collapsed against the extremity and no longer resists the applied pressure of the sleeve 26. Thus the extremity is exposed to the full pressure exerted by the sleeve 26. At this point, both the tube 22 of the cone 10 and the tube 28 of the sleeve 26 are blocked to maintain the applied pressure until the next cycle begins.

FIG. 5 is a schematic block diagram of the pneumatic control circuit utilized to operate the dynamic pressure wave device described above. A conventional source of pressurized air 32 provides the pneumatic input to the system and is regulated or otherwise limited to generate a predetermined maximum value of air pressure. Pneumatic flow is conducted from the regulated air supply 32 to an input of a two-way valve 34. The valve 34 directs the flow of pressurized air to one of two ports 34-1 and 34-2. The valve 34 is normally open to the port 34-1 and is switched to the other port 34-2 by a first solenoid 36. The port 34-1 is connected to a sleeve inflation damper 38. The damper 38 is a pneumatically-restrictive device which regulates the flow of air therethrough at a predetermined rate. Such damper 38 is typically spring-actuated and is conventional in the art. The damper 38 is connected to one port 40-1 of a two-way valve 40. The valve 40 is normally open to a port 40-2 and is switched to the port 40-1 by a second solenoid 42. The other port 40-2 of the valve 40 is connected to a sleeve exhaust line for venting the air from the sleeve 26 to the atmosphere. The input of the valve 40 is connected to the flexible tube 28 for inflating and deflating the sleeve 26, as will be explained in greater detail below.

The other port 34-2 of the valve 34 is connected to a cone inflation damper 44. The damper 44 is similar in construction and operation to the sleeve inflation damper 38. The port 34-2 is also connected to a pneumatic reservoir 46. The damper 44 is connected to one port 48-1 of a two-way valve 48. The valve 48 is normally open to a port 48-2 and is switched to the port 48-1 by a third solenoid 50. The input of the valve 48 is connected to the flexible tube 22 for inflating and deflating the cone 10. The input of the valve 48 is also connected to a cone pressure switch 52, the function of which will be explained below. The other port 48-2 of the valve 48 is connected through a check valve 54 to a cone deflation damper 56. The check valve 54 permits the one-way flow of pressurized air from the port 48-2 to the cone deflation damper 56. The cone deflation damper 56 is connected to an input of a two-way valve 58 which is normally open to one port 58-1 and is switched to another port 58-2 by the first solenoid 36. The port 58-1 of the valve 58 is connected to a cone exhaust line for venting the pressurized air from the cone 10 to the atmosphere. The other port 58-2 of the valve 58 is connected to the flexible tube 28 for inflating and deflating the sleeve 26. The port 58-2 is also connected through a damper 60 to a sleeve pressure transducer 62. The operation of the pneumatic control circuit illustrated in FIG. 5 will be discussed in detail below.

Figure 6:
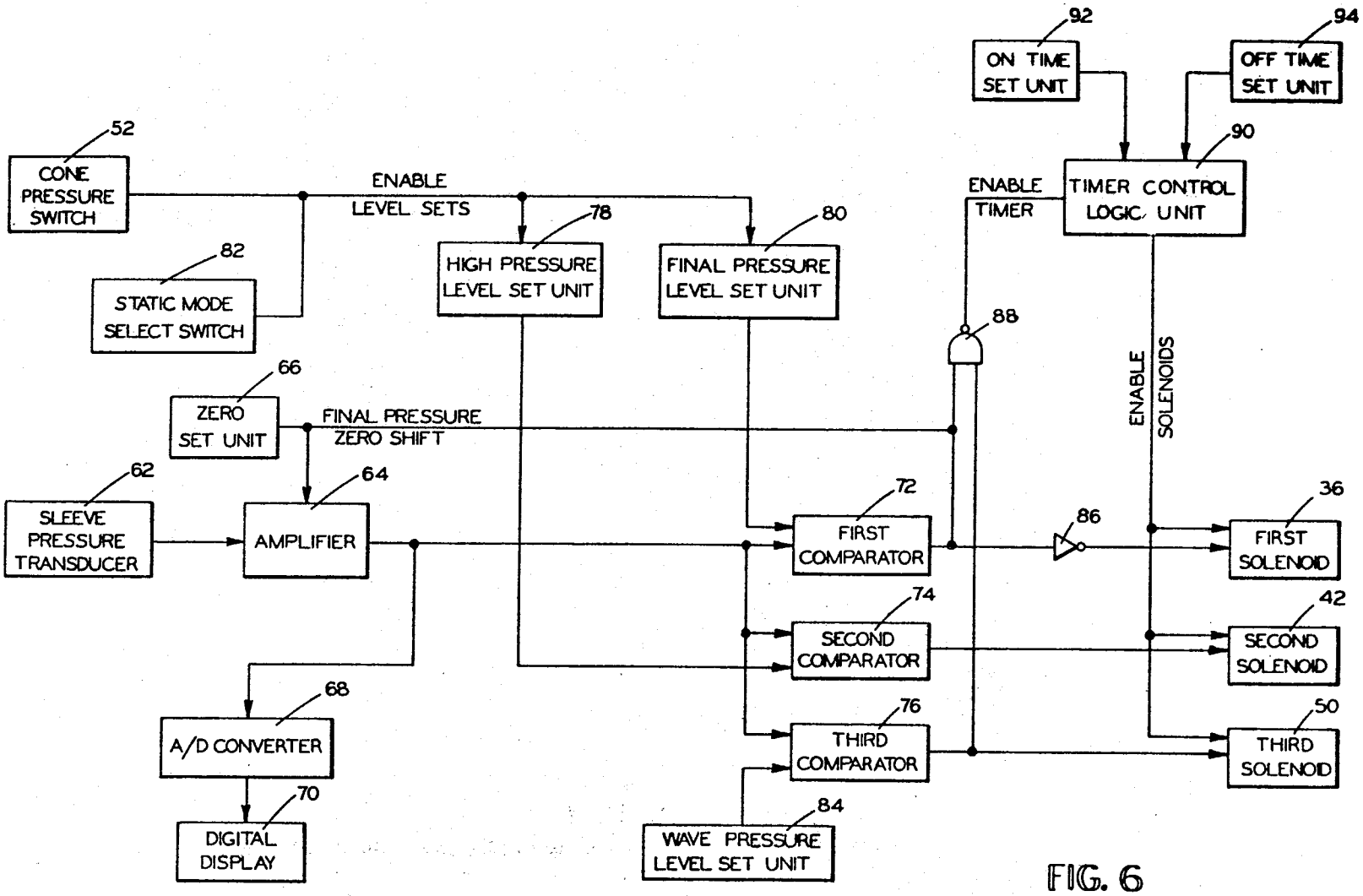
FIG. 6 is a schematic block diagram of the electronic circuit for controlling the pneumatic system of FIG. 5.

FIG. 6 schematically illustrates the electronic circuit for controlling the pneumatic control system described above. The sleeve pressure transducer 62 is one input to the electronic control circuit. The sleeve pressure transducer 62 can be a conventional strain-measuring resistive bridge. The transducer 62 generates an analog signal which represents the amount of air pressure contained within the sleeve 26. The signal from the transducer 62 is fed to an amplifier 64. A zero set unit 66 is connected to the amplifier 64 to provide a variable reference level to permit adjustment of the output of the amplifier 64 to zero when the pressure within the sleeve 26 is equal to the air pressure of the ambient surroundings. The output of the amplifier 64 is connected to an analog-to-digital converter 68. The A/D converter 68 is conventional in the art and converts the analog signal from the amplifier 64 to a digital signal which can drive a digital display 70. The display 70 provides an instantaneous visual representation of the pressure within the sleeve 26. The output of the amplifier 64 is also fed to a first comparator 72, a second comparator 74, and a third comparator 76. The comparators 72, 74, and 76 generate control signals which operate the solenoids 36, 42, and 50, respectively, as will be explained below.

The cone pressure switch 52 provides a second input to the electronic control system. The cone pressure switch 52 can be a pressure sensitive diaphragm switch which closes when the pressure in the cone 10 exceeds a predetermined level. The switch 52 is connected over a line ENABLE LEVEL SETS to a high pressure level set unit 78 and a final pressure level set unit 80. A static mode select switch 82 is also connected to the line ENABLE LEVEL SETS. The final pressure level set unit 80 provides a second input signal to the first comparator 72. The high pressure level set unit 78 provides a second input to the second comparator 74. A wave pressure level set unit 84 provides a second input to the third comparator 76. The level set units 78, 80, and 84 can be composed of voltage-dividing components which are individually adjustable so as to provide the various operating parameters of the system, as will be described below. Each of the level set units 78, 80, and 84 generates an electrical signal of a predetermined voltage to the appropriate comparator, which voltage signal is then compared with the amplified pressure signal generated by the sleeve pressure transducer 62 and the amplifier 64.

Each comparator can be composed of a pair of series-connected comparators, such as the model LM 339 package manufactured by National Semiconductor Corporation of Santa Clara, Calif. Each comparator generates a low signal when the signal from the appropriate level set unit is greater than the amplified signal from the sleeve pressure transducer 62. Each comparator generates a high signal when the amplified signal from the sleeve pressure transducer 62 is greater than or equal to the signal from the appropriate level set unit.

The output of the first comparator is connected through an inverter 86 to the first solenoid 36. The second and third comparators 74 and 76 are connected directly to the second and third solenoids 42 and 50, respectively. When a solenoid receives a low signal from a comparator, it will actuate the corresponding valve or valves to open towards the normally closed ports until a high signal is received, at which time the valve or valves will return to the normally open positions. Each solenoid 36, 42, and 50 includes conventional power driving circuitry (not shown).

The output of the first comparator 72 is fed back to the amplifier 64 over a FINAL PRESSURE ZERO SHIFT line. As will be explained in greater detail below, the final pressure zero shift signal is utilized to shift the zero reference point of the amplifier 64, as determined by the zero set unit 66, to accurately reflect the true air pressure within the sleeve 26, both when the sleeve 26 is being inflated and when the pneumatic control means described above is shut off.

The outputs of the first and third comparators 72 and 76 are inputs to a NAND gate 88. The NAND gate 88 output is connected over an ENABLE TIMER line to a timer control logic unit 90. The timer control logic unit 90 includes a conventional real time clock counter and means for generating timing signals to the solenoids so as to correlate selected operations of the dynamic pressure wave apparatus to predetermined intervals of time. The time control unit 90 is connected over an ENABLE SOLENOID line to each of the solenoids 36, 42, and 50. It will be appreciated that the timer control logic unit 90 is enabled to operate only when the first and third comparators 72 and 76 simultaneously generate high signal outputs. Such a condition occurs only when the sleeve 26 has been fully inflated and sealed and the cone 10 has been deflated. When the sleeve 26 reaches the final predetermined pressure to be applied to the extremity, the timer control logic unit 90 is enabled to regulate the length of time during which pressure will be applied to the extremity.

An on time set unit 92 and an off time set unit 94 are inputs to the timer control logic unit 90. The on time set unit 92 includes means for adjusting the length of time during which the sleeve applies the final pressure level against the extremity. The off time set unit 94 includes means for adjusting the length of time between cycles during which the sleeve chamber applies no pressure against the extremity. The on time set unit 92 and the off time set unit 92 are both conventional timers.

While the system is turned off and the solenoids are de-energized, the valves in the pneumatic control system will be connected to their normally open ports as shown in FIG. 5. Thus, the valve 40 will connect the sleeve 26 through the flexible tube 28 to the sleeve exhaust port 40-2 such that any pressure within the sleeve 26 will be vented to the atmosphere. Similarly, valve 48 will be open to the port 48-2 and valve 58 will be open to the port 58-1 such that any pressure within the cone 10 will be vented through the flexible tube 22, the check valve 54, and the cone deflation damper 56 to the atmosphere.

In the de-energized state, an operator can set the various operating parameters of the system. The static mode select switch 82 determines whether the appliance will apply a dynamic pressure wave or merely a pneumatic compressive force against the inserted extremity. As will be explained in greater detail below, the cone pressure switch 52 generates a signal when a predetermined pressure level in the cone 10 has been reached. The signal generated by the switch 52 enables the high pressure level set unit 78 and the final pressure level set unit 80 to generate their respective predetermined pressure level reference signals to the comparators 74 and 72. When the static mode select switch 82 is set for dynamic operation, it is an open circuit and has no effect on the operation of the cone pressure switch 52. However, when the static mode select switch 82 is set for static operation, the switch 82 continuously generates an enabling signal to the level set units 78 and 80, effectively removing the cone pressure switch 52 from the circuit. As will be explained below, operation of the dynamic pressure wave appliance in the static mode prevents the formation of the dynamic pressure wave and causes the appliance to exert merely a pneumatic compressive force against the inserted extremity as controlled by the circuit timing.

The operator next sets the two predetermined pressure reference levels for system operation. The wave pressure level set unit 84 determines the sleeve pressure at which the dynamic pressure wave will begin to be applied to the inserted extremity. The final pressure level set unit 80 determines the sleeve pressure which will be applied to the inserted extremity once the appliance is fully inflated. The high pressure level set unit 78 is preset to determine the sleeve pressure above the final pressure at which the sleeve 26 will be vented to the atmosphere. The high pressure level automatically changes with the final pressure level and is maintained at a predetermined differential above the final pressure level as set by the operator. The sleeve will vent even if the operator lowers the final pressure setting after the sleeve is inflated, if the actual sleeve pressure is equal to or greater than the high pressure level.

Finally, the operator can adjust the system to operate or cycle at predetermined intervals of time. The on time set unit 92 determines the length of time during which the final pressure of the sleeve 26 will be applied to the inserted extremity. The off time set unit 94 determines the length of time during which no pressure will be applied to the extremity, such as between cycles of compressive action.

When the various operating parameters of the system have been set, the system is energized. Initially, there is atmospheric pressure in the cone 10 and the sleeve 26. When the static mode select switch 82 is set for dynamic operation, the final pressure level set unit 80 and the high pressure level set unit 78 are disabled, since the cone pressure switch 52 is not yet activated by the pressure in the cone 10. Thus, the first and second comparators 72 and 74 receive predetermined pressure reference level signals of zero from the level set units 80 and 78, respectively. The third comparator 76 receives the predetermined pressure reference level from the wave pressure level set unit 84 regardless of the selected mode of operation. Thus, the first and second comparators 72 and 74 will generate high signals while the third comparator 76 will generate a low signal. However, since the output of the first comparator 72 is inverted by the inverter 86, the first and third solenoids 36 and 50 will be energized while the second solenoid 42 will remain de-energized. Thus, valve 34 will be moved to the port 34-2, the valve 58 will be moved to the port 58-2, and the valve 48 will be moved to the port 48-1. In this configuration, pneumatic flow from the regulated air supply 32 is conducted to the cone 10 at a rate controlled by the cone inflation damper 44. Such flow continues until the pressure within the cone 10 reaches the switch point level of the cone pressure switch 52.

The switch point level of the cone pressure switch 52 is set at a pressure to establish the desired collapsing action of the cone 10. When the cone pressure switch 52 closes, a signal is generated over the ENABLE LEVEL SETS line enabling the final pressure level set unit 80 and the high pressure level set unit 78 to generate their respective predetermined pressure level signals to the comparators 72 and 74. Upon receiving the final pressure reference level signal, the first comparator 72 will generate a low signal, causing the solenoid 36 to de-energize and connect the valves 34 and 58 to the ports 34-1 and 58-1, respectively. Similarly, the second comparator 74 will generate a low signal, causing the second solenoid 42 to actuate the valve 40 to the port 40-1. Such a configuration allows the pneumatic flow from the regulated air supply 32 to be conducted to the sleeve 26 at a rate controlled by the sleeve inflation damper 38. Upon the switching of the valves 34 and 58, any pressure differential developed across the cone inflation damper 44, the higher pressure being stored in the reservoir 46, is allowed to equalize into the cone 10, thereby raising the pressure in the cone slightly to preclude the need for a snap-action type pressure switch with an on/off pressure differential. The reservoir 46 can also provide enough volume in the section of the pneumatic circuit between valves 34 and 48 to maintain the circuit at a sufficient pressure in the event of a minor leak in a valve or fitting.

Pneumatic flow is conducted to the sleeve 26 through the flexible tube 28 until an initial wave pressure value is reached in the sleeve 26, as determined by the wave pressure level set unit 84. When the amplified signal from the sleeve pressure transducer 62 reaches the wave pressure value, the valve 48 is de-energized. The pressure in the cone 10 is vented through the line 22, the check valve 54, and the cone deflation damper 56 to the atmosphere. The rate at which the cone 10 is deflated is controlled by the cone deflation damper 56. At the same time, the sleeve 26 continues to be inflated. The pressure in the sleeve 26 is thus maintained at a constant level or increased, depending upon the relative rates of flow through the cone deflation damper 56 and the sleeve inflation damper 38. In either event, however, the cone 10 will lose the pressure which was previously built up. Since the sleeve 26 exerts an increasing compressive force on the exterior of the inflated cone 10 as it is inflated, the cone 10 will begin to collapse against the inserted extremity, as shown in FIG. 4B. Since the tapered end of the cone 10 has a smaller surface area exposed to the compressive force than the larger outer end, the tapered end will collapse first under the compressive force of the sleeve 26. As the pressure of the sleeve 26 increases and the pressure in the cone 10 decreases, the dynamic pressure wave will be applied to the extremity as shown in FIGS. 4B through 4D.

As the pressure in the sleeve 26 reaches the final pressure level of the system, as determined by the final pressure level set unit 80, the first comparator 72 will generate a high signal to the inverter 86. The inverter 86 will cause the first solenoid 36 to energize the valves 34 and 58 to the ports 34-2 and 58-2, respectively. In this configuration, pneumatic flow is discontinued to both the cone and the sleeve 26, which are effectively sealed. If the pressure in the cone 10 is greater than the pressure in the sleeve 26, such excess pressure is equalized into the sleeve 26 through the check valve 54. At this point, the appliance is exerting the desired final appliance pressure to the inserted extremity. Any decrease in the sleeve circuit pressure, as sensed by the sleeve pressure transducer 62, will cause the valves 34 and 58 to be re-energized in the manner described above so as to replenish the loss in the sleeve 26 and re-attain the desired final sleeve pressure level.

If the pressure in the sleeve 26 should reach or exceed the high pressure reference level, the second comparator 74 will be de-energized, causing the valve 40 to be moved to the port 40-2. Thus, the sleeve 26 will be vented through the line 28 to the atmosphere until the sleeve pressure drops below the high pressure reference level. As stated above, the venting will also occur if the operator lowers the final pressure setting below the actual sleeve pressure by the amount of the differential between the final and high pressure levels.

When the system has reached and is maintaining the final pressure level of the sleeve 26 against the inserted extremity, the first and third comparators 72 and 76 are generating high signals to the NAND gate 88. In response to such high signal inputs, the NAND 88 will generate an enabling signal over the ENABLE TIMER line to the timer control logic unit 90. When the control unit 90 is enabled, the system will be regulated in accordance with the on time set unit 92 and the off time set unit 94, as described above. Thus, the pressure monitoring and control can continue in a cycle indefinitely or for as long as the appliance sleeve pressure is desired to be applied.

If, when the system is initially energized, the static mode select switch 82 is in the position for static operation, an enabling signal will be generated immediately to the final pressure set unit 80 and the high pressure set unit 78. Thus, each of the comparators 72, 74, and 76 will generate a low signal when the system is initially energized. In response thereto, the first solenoid 36 will be de-energized and the second and third solenoids will be energized such that the valve 40 is open to the port 40-1 and the valve 48 is open to the port 48-1. In the static mode of operation, it will be appreciated that the cone 10 is never inflated. Rather, the system immediately begins inflating the sleeve 26 to the desired final pressure, as determined by the final pressure level set unit 80. From this point, the operation of the system is identical to that described above. The result is that a pneumatic compressive force is applied to the inserted extremity by the sleeve 26 without the application of the dynamic pressure wave.

Because of the dynamic flow resistance inherent in the pneumatic inflating and deflating control means described above, pressure drops will occur throughout the system as the apparatus is inflated to a desired pressure level. If the pressure transducer 62 or other indicating device is located anywhere in the system but in the apparatus itself, it will sense a dynamic pressure higher than that of the actual pressure within the apparatus as the pneumatic system inflates the apparatus. When the system shuts off and the apparatus is no longer inflating or deflating, the system pressures will equalize at a static pressure value which is equivalent to the actual pressure within the apparatus. The differential between the measured dynamic pressure and the actual dynamic pressure is a function of the volume and construction of the pneumatic system and the apparatus. It will thus be appreciated that, without compensation, the displayed pressure may be higher than the actual pressure during inflation of the apparatus and could only be a true measurement of the pressure within the apparatus when the inflation stopped. If the pressure transducer were calibrated to reflect the true dynamic filling pressure of the apparatus, the shut off value would be significantly lower than the true apparatus value. However, if at shut off, the pressure transducer reference were suitably shifted, the displayed pressure value would be accurate both when the apparatus was being inflated and when the inflation had stopped.

As illustrated in FIG. 6, the output of the first comparator 72 is fed back to the amplifier 64 over the FINAL PRESSURE ZERO SHIFT line. As the sleeve 26 is being inflated and the pressure of the air contained therein is less than the final pressure level as determined by the set unit 80, the first comparator 72 is generating a low signal to the inverter 86. That low signal is fed over the FINAL PRESSURE ZERO SHIFT line to the amplifier 64. The low signal causes the zero set point of the amplifier 64 to be shifted downwardly such that the output of the amplifier accurately reflects the actual pressure of the air contained within the sleeve. When the actual value of the pressure within the sleeve 26 exceeds the final pressure level as determined by the set unit 80, the first comparator 72 will generate a high signal over the final pressure zero shift line to the amplifier 64, causing the zero set point of the amplifier 64 to move upwardly such that the output of the amplifier accurately reflects the actual pressure of the air contained within the sleeve 26 during the static condition. Thus, it will be appreciated that the electronic circuit of the present invention shifts the reference level of the sleeve pressure transducer 62 to compensate for pressure drops within the pneumatic control system caused by dynamic flow resistance.

In accordance with the provisions of the patent statutes, the principle and mode of operation of the present invention have been explained and illustrated in their preferred embodiment. However, it must be understood that the invention can be practiced otherwise than as specifically described and illustrated without departing from its spirit or scope.

What is claimed is:

1. In an apparatus intended for use in applying compressive pressure to a mammal extremity including a first inflatable chamber surrounding the extremity, a second inflatable chamber enclosing the first chamber, and a pneumatic control means pneumatically connected to the first and second chambers for inflating and deflating the chambers from a source of pressurized gas such that the chambers apply compressive pressure to the extremity, a pneumatic control means comprising:

means for connecting a source of pressurized gas to a first chamber so as to inflate the first chamber;

means for disconnecting the source from the first chamber so as to seal the first chamber and for connecting the source to a second chamber so as to inflate the second chamber when the pressure within the first chamber reaches a first predetermined level; and means for disconnecting the source from the first chamber so as to deflate the first chamber while continuing to connect the source to the second chamber so as to inflate the second chamber when the pressure within the second chamber reaches a second predetermined level.

2. A pneumatic control circuit in accordance with claim 1 including means for disconnecting the source from the second chamber so as to seal the inflated second chamber when the pressure within the second chamber reaches a third predetermined level.

3. A pneumatic control circuit in accordance with claim 2 including means for disconnecting the source from the first and second chambers so as to deflate the first and second chambers after a predetermined time.

4. A pneumatic control circuit in accordance with claim 3 wherein said means for connecting and disconnecting the source from the first and second chambers includes valve means pneumatically connected between the source and the first and second chambers.

5. A pneumatic control circuit in accordance with claim 1 wherein said means for connecting the source of pressurized gas to the first chamber includes reservoir means for storing a volume of gas under pressure.

6. A pneumatic control circuit in accordance with claim 1 wherein said means for connecting the source of pressurized gas to the first chamber includes damper means for regulating the rate of flow of pressurized gas between the source and the first chamber.

7. A pneumatic control circuit in accordance with claim 1 wherein said means for connecting the source of pressurized gas to the second chamber includes damper means for regulating the rate of flow of pressurized gas between the source and the second chamber.

8. A pneumatic control circuit in accordance with claim 1 wherein said means for deflating the first chamber includes damper means for regulating the rate of flow of pressurized gas between the first chamber and an exhaust port.

9. A pneumatic control circuit in accordance with claim 8 wherein said means for deflating the first chamber includes check valve means for permitting the one-way flow of gas from the first chamber to said damper means.

10. A pneumatic control circuit in accordance with claim 1 including means for equalizing the pressures between the first and second chambers when the pressure in the first chamber exceeds the pressure in the second chamber.

11. A pneumatic control circuit in accordance with claim 10 wherein said equalizing means includes a check valve for permitting one-way flow of gas from the first chamber to the second chamber.

12. In an apparatus intended for use in applying compressive pressure to a mammal extremity including a first inflatable chamber surrounding the extremity, a second inflatable chamber enclosing the first chamber, and a pneumatic control means pneumatically connected to the first and second chambers for inflating and deflating the chambers from a source of pressurized gas such that the chambers apply compressive pressure to the extremity, a pneumatic control means comprising:

means for inflating a first chamber;

means for sealing the first chamber and for inflating a second chamber when the pressure within the first chamber reaches a first predetermined level; and means for deflating the first chamber while continuing to inflate the second chamber when the pressure within the second chamber reaches a second predetermined level.

13. A pneumatic control circuit in accordance with claim 12 further including means for sealing the inflated second chamber when the pressure within the second chamber reaches a third predetermined level.

14. A pneumatic control circuit in accordance with claim 13 further including means for deflating the first and second chambers after a predetermined time.

* * * * *